US006234075B1

(12) United States Patent
Kayser

(10) Patent No.: US 6,234,075 B1
(45) Date of Patent: May 22, 2001

(54) CALENDER ROLL SYSTEM

(75) Inventor: Franz Kayser, Geldern (DE)

(73) Assignee: Voith Sulzer Papiertechnik Patent GmbH, Heidenheim (DE)

( * ) Notice: Subject to any disclaimer, the term of this patent is extended or adjusted under 35 U.S.C. 154(b) by 0 days.

(21) Appl. No.: 09/238,576

(22) Filed: Jan. 28, 1999

(30) Foreign Application Priority Data

Jan. 29, 1998 (DE) ..... 198 03 323

(51) Int. Cl.[7] ..... B30B 3/04

(52) U.S. Cl. ..... 100/163 A; 100/162 R; 100/172

(58) Field of Search ..... 100/42, 172, 163 R, 100/163 A, 162 R

(56) References Cited

U.S. PATENT DOCUMENTS

| | | | | |
|---|---|---|---|---|
| 3,044,392 | | 7/1962 | Minarik . | |
| 5,029,521 | * | 7/1991 | Pav et al. | 100/163 R |
| 5,655,442 | * | 8/1997 | Connrad et al. | 100/163 R |
| 5,704,285 | * | 1/1998 | van Haag | 100/163 R |
| 5,911,174 | * | 6/1999 | Cramer et al. | 100/162 R |

FOREIGN PATENT DOCUMENTS

| | | |
|---|---|---|
| 252151 | 10/1912 | (DE) . |
| 29518424 | 4/1996 | (DE) . |
| 19650576 | 6/1998 | (DE) . |
| 1156937 | 7/1969 | (GB) . |

* cited by examiner

*Primary Examiner*—Peter Vo
*Assistant Examiner*—Louis K. Huynh
(74) *Attorney, Agent, or Firm*—Greenblum & Bernstein P.L.C.

(57) ABSTRACT

A calender roll system and method for operating the same. The calender roll system includes a roll stack having at least one center roll positioned between two end rolls, in which each of the at least one center roll and the two end rolls have a drive mechanism, and in which the rolls can be loaded in a stacking direction. The method includes loading the rolls to form at least one working nip with at least one center roll, and, in the at least one working gap, bending the at least one center roll out of the plane of the roll stack. Reaction forces required to bend the at least one center roll are generated by corresponding adjustment of drive moments of the at least one center roll.

22 Claims, 2 Drawing Sheets

CALENDER ROLL SYSTEM

CROSS-REFERENCE TO RELATED APPLICATIONS

The present application claims priority under 35 U.S.C. §119 of German Patent Application No. 198 03 323.0, filed on Jan. 29, 1998, the disclosure of which is expressly incorporated by reference herein in its entirety.

BACKGROUND OF THE INVENTION

1. Field of the Invention

The present invention relates to a calender roll system and a method of operating the calender roll system. The calender roll system includes a roll stack having at least one center roll between two end rolls, and a drive mechanism for each of the end and center rolls. The rolls can be loaded in the stacking direction.

2. Discussion of Background Information

German Patent Disclosure DE 295 18 424 discloses a known calender roll system of the type generally discussed above, in which five and more rolls, preferably eight rolls, are arranged one above the other. The rolls form a number of working nips or gaps, which are defined by one hard roll and one elastic roll, and one varying nip, which is defined by two elastic rolls. Each roll is provided with its own drive mechanism. Auxiliary drive mechanisms are additionally provided to bring the circumferential speed of the applicable roll to the web speed, so that the roll system can be operated at the paper infeeding speed.

SUMMARY OF THE INVENTION

The present invention provides a novel variation of the calender roll system generally discussed above.

The present invention provides a method in which at least one center roll associated with at least one working nip is bent out of the plane of the roll stack, and the reaction forces required for the bending are generated by corresponding adjustment of the drive moments of the drive mechanisms.

Thus, by purposefully deflecting one, several, or all of the rolls crosswise to the center plane of the roll stack, a transverse compressive strain profile (crosswise pressure profile) can be varied. Within a wide allowable range, lesser to greater corrections may be attained, depending on the degree of sagging. In particular, the deflection of one roll may be adapted to a deflection of the neighboring roll, which results in a high degree of uniformity. This may be applicable particularly to the first and last working nips, because the end rolls are engaged by a reaction force that cannot be undershot, which leads to a deflection that is dependent only on the rigidity of the roll.

In accordance with the present invention, the feature of varying the compressive strain in the at least one working nip by increasing the difference in deflection of the rolls defining the working nip is based on a novel discovery that, if the bending lines of adjacent rolls spread apart, relief occurs not in the center of the web, for instance, but rather in peripheral regions of the web. To relieve the compressive strain in a peripheral region, the drive mechanism is utilized to transfer the drive moment, while to load the peripheral region, the drive moments are distributed more uniformly. In this manner, the drive mechanisms can be triggered to achieve relief or loading of the peripheral region in a simple way.

By closed-loop control of the transverse compressive strain profile, control of one web parameter pertaining to the web width may be monitored, and, upon a control deviation, at least some of the correction is accomplished by varying the drive moments. In this regard, the drive mechanisms are part of the control loop.

It may be preferred to select the drive moments so that reaction forces of adjacent rolls and, thus, their deflection are not equal to zero. This feature offers the advantageous possibility that the shear forces in the web may be virtually zero. However, this is on the precondition that deflection of the rolls is present. It has been found that paper produced in this way has greater tear strength.

It may be advantageous to keep the least value of the reaction forces unequal to zero so that the bearings for the rolls, embodied as rolling-contact bearings, have a longer service life because they are constantly under load.

It may also be advantageous that a center roll adjacent to one of the end rolls is bent out of the plane of the stack in a same direction as the end roll so as to lead to a very uniform transverse compressive strain profile.

Moreover, the calender roll system of the present invention includes at least one center roll having a slenderness ratio greater than approximately 10 and an open-loop control device for supplying drive moments. In this manner, the reaction forces $F_R$ at the at least one center roll and, thus, a deflection of the at least one center roll out of the center plane of the stack may be within an allowable range. In this regard, center rolls with a slenderness ratio over approximately 10 are very easily bendable and, therefore, will exceed the boundary of the allowable range unless contrary control by the drive moments is provided. For example, the allowable range is exceeded if the bending lines of adjacent rolls are spread so far apart that the ends of the rolls lift away from one another. The slenderness ratio is defined as a ratio of the length of a roll to its diameter. Such slender rolls are of great advantage, because due to their greater curvature they lead to a higher compressive strain in the nip, and because they have a lower weight.

It may be preferable for the rolls to have a slenderness ratio between approximately 12 and 16, and, most preferably approximately 14.

The two end rolls may have a lower slenderness ratio than the center rolls. In this manner, unavoidable deflection of the end rolls may be reduced so that even the adaptation of the next roll to the sagging of the end roll requires only slight deflection.

The calender roll system can also be arranged off-line. In this manner, a calender roll system, which operates independently of the papermaking machine, runs at a considerably lower speed than an in-line calender roll system coupled to a paper-making machine. For this kind of off-line calender roll system, a single drive mechanism on a roll that drags all the other rolls along by friction was thought in the prior art to be sufficient, however, this precluded utilizing the effects of the single drive mechanism.

The diameter of at least one center roll is preferably at most approximately 100 cm, and this upper limit value corresponds with a calender roll system having a width of approximately 10 meters and more.

Accordingly, the present invention is directed to a method for operating a calender roll system for a web material. The calender roll system includes a roll stack having at least one center roll positioned between two end rolls, in which each of the at least one center roll and the two end rolls have a drive mechanism, and in which the rolls can be loaded in a stacking direction. The method includes loading the rolls to form at least one working nip with at least one center roll, and, in the at least one working gap, bending the at least one center roll out of the plane of the roll stack. Reaction forces required to bend the at least one center roll are generated by corresponding adjustment of drive moments of the at least one center roll.

In accordance with another feature of the present invention, the method further includes changing a difference in deflection of the at least one center roll and an adjacent roll forming the at least one working nip. In this way, at least one of the compressive strain in the peripheral regions of the web may be reduced and the compressive strain in the center of the web may be increased.

In accordance with still another feature of the present invention, the method further includes at least one of transferring the drive moments of the at least one center roll from the drive mechanism, such that the compressive strain in a peripheral region may be relieved, and more uniformly distributing the drive moments, such that the peripheral region may be loaded.

In accordance with a further feature of the present invention, the calender roll system further includes a closed-loop control, and the method further includes monitoring at least one web parameter over a width of the web, and controlling a transverse compressive strain profile with the closed-loop control in accordance with the monitored parameter. In this manner, upon a control deviation of the monitored parameter, the drive moments are varied.

In accordance with still another feature of the present invention, the method further includes selecting the drive moments such that the reaction forces of adjacent rolls and thereby their deflection are unequal to zero, and such that the shear forces in the web are virtually zero.

In accordance with another feature of the present invention, the method further including selecting the drive moments such that a least value of the reaction forces is unequal to zero.

In accordance with a still further feature of the present invention, the at least one center roll may be positioned adjacent to one of the end rolls, and the method further includes bending the at least one center roll out of the plane of the roll stack in a same direction as a deflection of the one end roll.

In accordance with another feature of the present invention, the method further includes guiding a paper web through the calender roll system.

The present invention is also directed to a calender roll system for web material that includes a plurality of rolls arranged in a roll stack of rolls having at least one center roll positioned between two end rolls. Each of at least two end rolls and the at least one center roll have a drive mechanism and may be adapted to be loaded in a stacking direction. The at least one center roll has a slenderness ratio greater than approximately 10. An open-loop control device may be adapted to supply drive moments, such that reaction forces at the at least one center roll and deflection of the at least one center roll out of the center plane of the roll stack are maintained within a predetermined allowable range.

In accordance with another feature of the present invention, the two end rolls of the roll stack may have a slenderness ratio of less than approximately 10.

The present invention is also directed to a method for operating a calender roll system for calendering a web. The calender roll system may include a roll stack having at least one center roll positioned between a top and a bottom roll, in which each of the at least one center roll and the top and bottom rolls have a drive mechanism, and in which the rolls can be loaded in a stacking direction. The method includes calculating reaction forces for the top roll, obtaining reaction forces for the at least one center roll from the reaction forces of the top roll, and adjusting the reaction forces of the at least one center roll by varying a drive moment of the drive mechanism for the at least one center roll.

In accordance with another feature of the present invention, the method further includes calculating the reaction forces for the top roll from the circumferential forces, friction moments and a diameter of the top roll.

In accordance with still another feature of the present invention, the method further includes obtaining the reaction forces for the at least one center roll from differences in the circumferential forces.

In accordance with a further feature of the present invention, the method further includes adjusting a compressive strain in at least one of peripheral regions of the web and a center region of the web by varying the drive moment of the drive mechanism for the at least one roll.

In accordance with still further feature of the present invention, the method further includes monitoring at least one web parameter over a width of the web, comparing the monitored parameter to a predetermined value, and varying drive moments of the drive mechanisms when a deviation range from the predetermined value is detected.

In accordance with another feature of the present invention, the method further includes coupling the calender roll system to a web producing machine, and guiding a finished web from the web producing machine to the calender roll system.

In accordance with a further feature of the present invention, the method further includes operating the calender roll system independently of a web producing machine.

In accordance with still another feature of the present invention, the reaction force for the top roll is represented by $F_{R1}$, and the method further includes calculating the reaction force for the top roll from the equation:

$$F_{R1} = \frac{F_{U1}}{2} + 2\frac{M_{R1}}{D_1}$$

in which $F_{U1}$ represents circumferential forces of the top roll; $M_{R1}$ represents friction moments of the top roll; and $D_1$ represents the diameter of the top roll.

In accordance with another feature of the present invention, the method further including calculating the circumferential force $F_{U1}$ from the equation:

$$F_{U1}=F_{N1}+\Delta B_{Z1}$$

in which $F_{N1}$ represents force necessary to overcome calendering resistance; and $\Delta B_{Z1}$ represents a change in the web tension force.

In accordance with a still further feature of the present invention, the at least one center roll is positioned adjacent to the top roll, and the method further includes calculating the circumferential force $F_{U2}$ of the at least one center roll from the equation:

$$F_{U2}=F_{N2}+\Delta B_{Z2}$$

in which $F_{N2}$ represents force necessary to overcome calendering resistance; and $\Delta B_{Z2}$ represents a change in the web tension force.

In accordance with another feature of the present invention, the reaction force for the at least one center roll is represented by $F_{R2}$, and the method further includes calculating the reaction force $F_{R2}$ for the at least one center roll from the equation:

$$F_{R2}=\frac{1}{2}(F_{U1}-F_{U2}).$$

In accordance with yet another feature of the present invention, the method further includes varying the drive moments of the at least one roll to adjust the calculated reaction force $F_{R2}$, and, thereby, the deflection of the at least one center roll to adjust a compressive strain profile through a working nip formed by the at least one center roll and the top roll.

Other exemplary embodiments and advantages of the present invention may be ascertained by reviewing the present disclosure and the accompanying drawing.

BRIEF DESCRIPTION OF THE DRAWINGS

The present invention is further described in the detailed description which follows, in reference to the noted plurality of drawings by way of non-limiting exemplary embodiments of the present invention, in which like reference numerals represent similar parts throughout the several views of the drawings, and wherein.

DETAILED DESCRIPTION OF THE PRESENT INVENTION

The particulars shown herein are by way of example and for purposes of illustrative discussion of the embodiments of the present invention only and are presented in the cause of providing what is believed to be the most useful and readily understood description of the principles and conceptual aspects of the present invention. In this regard, no attempt is made to show structural details of the present invention in more detail than is necessary for the fundamental understanding of the present invention, the description taken with the drawings making apparent to those skilled in the art how the several forms of the present invention may be embodied in practice.

Figure 1:
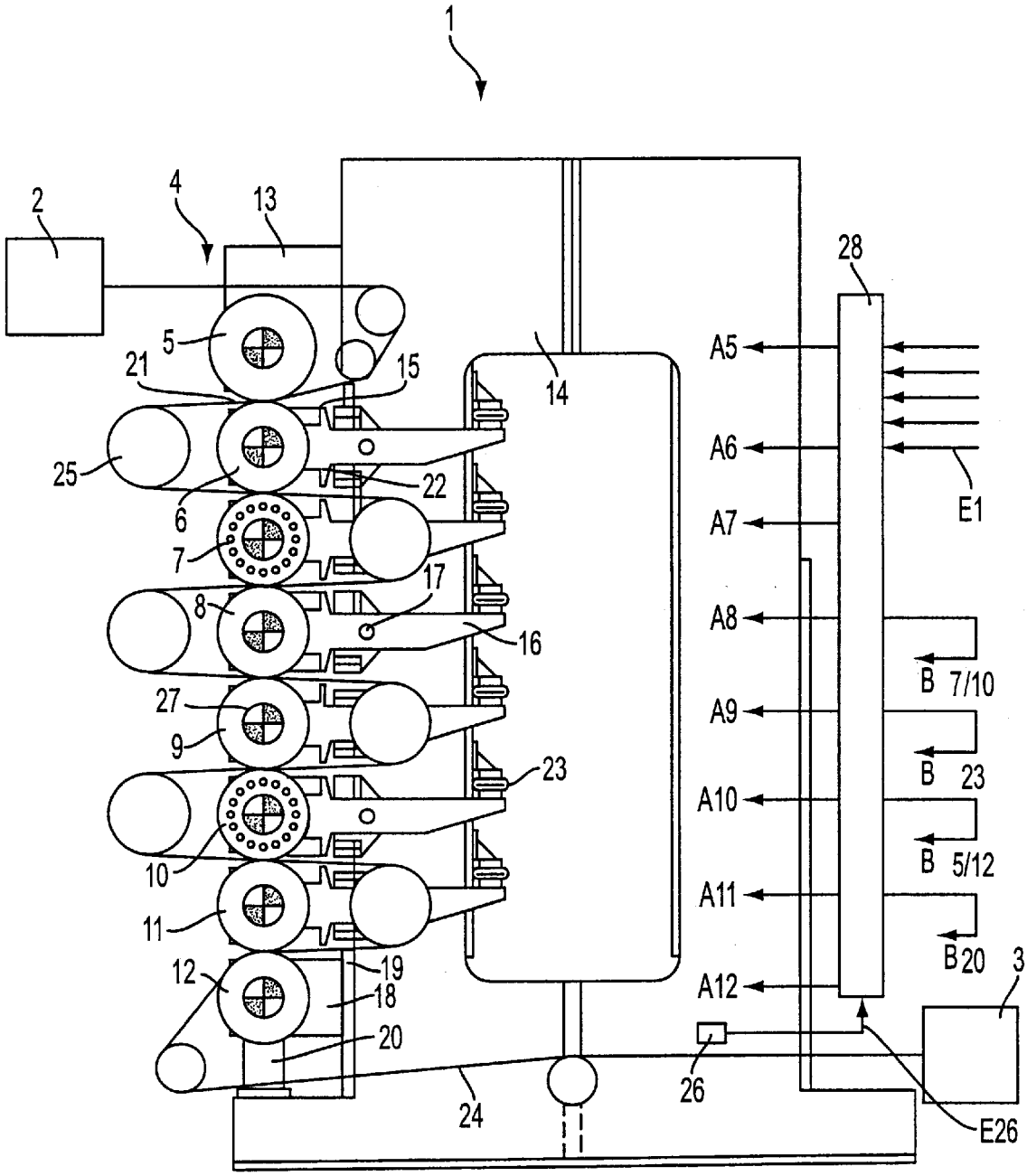
FIG. 1 schematically illustrates a calender roll system according to the features of the present invention.

A calender roll system 1, as schematically illustrated in FIG. 1, may be arranged, e.g., as an off-line calender roll system, between a payout station 2 and a winding station 3. However, calender roll system 1 may also be utilized as an in-line calender roll system and arranged to follow an outlet side of a paper-making machine. Calender roll system 1 may include a vertical roll stack 4 composed of a plurality, e.g., eight, rolls 5–12. Roll stack 4 may include top roll 5 and bottom roll 12, which may both be formed as zonally controlled deflection adjustment rolls, and center rolls 6–11 arranged between top roll 5 and bottom roll 12. Four of the center rolls, e.g., rolls 5, 7, 10 and 12, may have a hard metal surface, and four of the center rolls, e.g., rolls 6, 8, 9 and 11, may have an elastic plastic lining. Rolls 7 and 10 can be heated with hot steam.

A bearing block 13 of top roll 5 may be fixedly mounted to stand 14 of calender roll system 1. Bearing blocks 15 and center rolls 6–11 are supported by levers 16, which are rotatable about pivot shafts 17 secured to stand 14. Bearing block 18 for bottom roll 12 may be mounted on a vertical guide 19, which can be pressed upwardly by a hydraulic cylinder 20, to produce an adequate line load in working nip or gaps 21 of roll stack 4. When hydraulic cylinder 20 is lowered, center rolls 6–11 follow it until the associated levers 16 come to rest on a stop 22 and all the roll nips are open. Levers 16 may be loaded by force transducers 23, with which the loads and weights suspended from the levers can be compensated for entirely or in part.

A paper web 24 is fed through roll nips 21 with the aid of guide rolls 25. On an outlet side of calender roll system 1, measuring device 26 is provided to measure parameters of paper web 24, e.g., gloss, smoothness, thickness, or the like. Measuring device 26 may be arranged so as to measure the parameters over the entire width of paper web 24, e.g., via a reciprocating measurement element or via a plurality of measuring elements distributed over the width.

Each of rolls 5–12 has its own drive mechanism 27, whose drive moment is predetermined by an open-loop control device 28, schematically represented by outputs A5–A12. Control device 28 may also include additional outputs, e.g., an output B20, which determines a pressure for hydraulic cylinder 20; outputs B5/12, which determine the pressure in the deflection adjustment devices of end rolls 5 and 12; outputs B23, which determine the pressure in force transducers 23, and outputs B7/10, which determine the supply of the heat transfer medium to the heatable rolls 7 and 10.

A plurality of inputs E1 may be utilized to input data essential to paper finishing, e.g., the desired values for the desired paper parameters. Other inputs, such as input E26 may be provided to input measured actual values, such as the smoothness, gloss or thickness.

Figure 2:
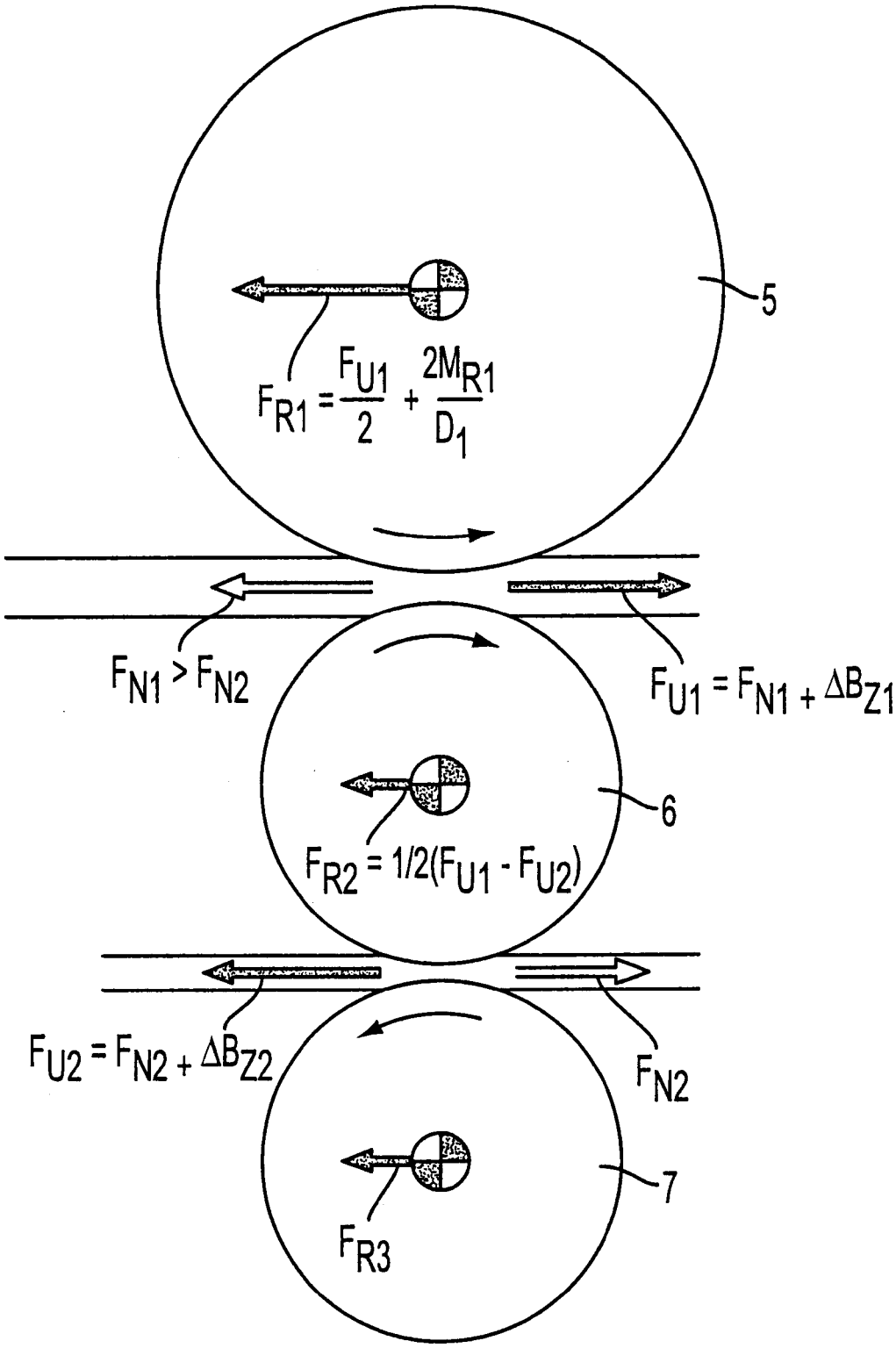
FIG. 2 schematically illustrates the force ratios in the three uppermost rolls of the roll stack.

In FIG. 2, $F_N$ represents a force necessary to overcome calendering resistance, which serves to overcome compression of the elastic roll liner and the elastic and plastic components of paper deformation. $F_N$ varies with the physical properties, e.g., density and smoothness, of paper web 24 from one nip to another, i.e., not only with a roll load characteristic curve.

$M_R$ represents friction moments of the bearings for the rolls and optionally of ductors and sealing heads, e.g., rotary infeeds for heating or cooling media. The latter can markedly exceed the friction of the bearings. In deflection adjustment rolls, such as top roll 5 and bottom roll 12, friction from the oil flow between the fixed shaft and the rotating jacket and the hydrostatic oil gaps, or from the sealing strips in the case of, e.g., S-rolls, predominates.

$F_U$ represents force exerted on the rolls by paper web 24 which is required to overcome the calendering resistance and optionally any existing web tension force $B_Z$.

In FIG. 2, it may be assumed that the forces $F_U$ are distributed, one-half to each of the two rolls forming the roll nip. Since the calendering resistances and, therefore, the forces $F_N$ decrease from the top of roll stack 4 to the bottom, this also pertains to the circumferential forces $F^U$.

From the circumferential forces $F_{U1}$, the friction moments $M_{R1}$ and the diameter $D_1$ of roll 5, $F_{R1}$ can be calculated, i.e., it cannot be made zero. From the differences in the circumferential forces, reaction forces for the center rolls are obtained, which can be varied by varying the drive moment of the individual drive mechanisms within a certain scope. It is important to note that the reaction forces $F_R$ are responsible for the sagging, i.e., the lateral deflection of the rolls.

According to the present invention, an open-loop control device 28 is provided to adjust the drive moments for each individual drive mechanism, i.e., to vary the transverse compressive strain profile. A high degree of uniformity in the compressive strain may be obtained whenever deflection of the uppermost center roll 6 out of the center plane of roll stack 4 is adapted to the unavoidable deflection of top roll 5. Even if the deflection of top roll 5 is only slight, adapting the bending line of roll 6 results in an improvement in the transverse compressive strain profile.

In other cases, e.g., if the edge pressure is too great, it may be valuable to spread the bending lines of adjacent rolls, i.e., their center lines, so as to reduce the compressive strains at the edges of the web.

Another favorable mode of operation, with which paper that has particular tensile strength can be attained, provides that no shear forces are exerted on the web. Once again, the prerequisite is a certain deflection of the center rolls.

Because a certain reaction force and deflection is desired anyway, the bearings for the rolls constantly undergo a certain load and therefore have a long service life.

In a particular embodiment, center rolls 6–11 may have a slenderness ratio (i.e., length of the roll to its diameter) of greater than approximately 10, preferably between approximately 12 and 16, and, most preferably approximately 14. Suitably adjusting the drive moments of individual drive mechanisms 27 necessarily prevents excessive bending of the rolls, so that the compressive strain values remain within the allowable range, and, in particular, the rolls do not lift away from one another at their ends.

In accordance with the present invention, it is also possible to provide for purposeful friction in the roll gap.

Departures in various respects can be made from the foregoing exemplary embodiment without departing from the fundamental concept of the invention. In particular, calender roll system 1 may also be utilized in in-line operation. Moreover, the number of rolls may vary, with the preferred number of rolls being between 4 and 8. Further, end rolls 5 and 12 may also be formed as elastic rolls and may be adjacent to hard center rolls.

It is noted that the foregoing examples have been provided merely for the purpose of explanation and are in no way to be construed as limiting of the present invention. While the present invention has been described with reference to a exemplary embodiment, it is understood that the words which have been used herein are words of description and illustration, rather than words of limitation. Changes may be made, within the purview of the appended claims, as presently stated and as amended, without departing from the scope and spirit of the present invention in its aspects. Although the present invention has been described herein with reference to particular means, materials and embodiments, the present invention is not intended to be limited to the particulars disclosed herein; rather, the present invention extends to all functionally equivalent structures, methods and uses, such as are within the scope of the appended claims.

What is claimed:

1. A calender roll system for web material comprising:

a plurality of rolls arranged along a stack plane in a roll stack, the plurality of rolls including at least one center roll positioned between at least two end rolls;

each of the at least two end rolls and the at least one center roll having a drive mechanism for driving each roll and adapted to be loaded in a stacking direction;

the at least one center roll having a slenderness ratio greater than approximately 10; and a control device for adjusting drive moments of each drive mechanism, wherein the control device is adapted to vary a transverse compressive strain profile by adjusting the drive moments of each of the at least two end rolls and the at least one center roll, and wherein the at least one center roll is adapted to be deflected out of the stack plane when the control device varies the drive moments.

2. The calender roll system of claim 1, wherein the slenderness ratio is between approximately 12 and 16.

3. The calender roll system of claim 1, wherein the slenderness ratio is approximately 14.

4. The calender roll system of claim 1, wherein the at least two end rolls of the roll stack have a slenderness ratio of less than approximately 10.

5. The calender roll system of claim 1, wherein the system is adapted as an off-line device.

6. The calender roll system of claim 1, wherein the at least one center roll has a diameter less than or equal to approximately 100 cm.

7. The calender roll system of claim 1, wherein the control device comprises an open-loop control device.

8. The calender roll system of claim 1, further comprising a measurement device adapted to measure at least one parameter of the web.

9. The calender roll system of claim 1, wherein the control device is adapted to produce outputs.

10. The calender roll system of claim 9, wherein the outputs comprise one of an output for adjusting a hydraulic cylinder pressure, an output for controlling deflection of the at least two end rolls, and output for controlling at least one force transducer, and an output for controlling a temperature of at least one roll in the roll stack.

11. A calender roll system for web material comprising:

a plurality of rolls arranged to be moveable along a stack plane in a roll stack, the plurality of rolls including at least one center roll positioned between at least two end rolls;

each of the at least two end rolls and the at least one center roll having a drive mechanism for driving each roll and adapted to be loaded in a stacking direction;

the at least one center roll having a slenderness ratio greater than approximately 10; and a control device for adjusting drive moments of each drive mechanism; and a measurement device for measuring at least one parameter of the web, wherein the control device is adapted to vary a transverse compressive strain profile by adjusting the drive moments of each of the at least two end rolls and the at least one center roll, and wherein the at least one center roll is adapted to be deflected out of the stack plane when the control device varies the drive moments.

12. The calender roll system of claim 11, wherein the measurement device measures the at least one parameter across the entire width of the web.

13. The calender roll system of claim 11, wherein the slenderness ratio is between approximately 12 and 16.

14. The calender roll system of claim 11, wherein the slenderness ratio is approximately 14.

15. The calender roll system of claim 11, wherein the at least two end rolls of the roll stack have a slenderness ratio of less than approximately 10.

16. The calender roll system of claim 11, wherein the system is adapted as an off-line device.

17. The calender roll system of claim 11, wherein the at least one center roll has a diameter less than or equal to approximately 100 cm.

18. The calender roll system of claim 11, wherein the control device comprises an open-loop control device.

19. The calender roll system of claim 11, wherein the control device is adapted to produce outputs.

20. The calender roll system of claim 19, wherein the outputs comprise one of an output for adjusting a hydraulic cylinder pressure, an output for controlling deflection of the at least two end rolls, and output for controlling at least one force transducer, and an output for controlling a temperature of at least one roll in the roll stack.

21. The calender roll system of claim 11, wherein the control device is adapted to monitor the at least one parameter of the web via the measurement device and vary the drive moments to control the at least one parameter.

22. A calender roll system for web material comprising:

a plurality of rolls arranged to be moveable along a stack plane in a roll stack, the plurality of rolls including at least one center roll positioned between at least two end rolls;

each of the at least two end rolls and the at least one center roll having a drive mechanism for driving each roll and adapted to be loaded in a stacking direction;

the at least one center roll having a slenderness ratio greater than approximately 10; and a control device for adjusting drive moments of each drive mechanism; and a measurement device for measuring at least one parameter of the web, wherein the control device is adapted to monitor the at least one parameter of the web and vary the drive moments to control the at least one parameter and is adapted to vary a transverse compressive strain profile by adjusting the drive moments, and wherein the at least one center roll is adapted to be deflected out of the stack plane when the control device varies the drive moments.

* * * * *